US012617589B2

(12) United States Patent
Moore

(10) Patent No.: US 12,617,589 B2
(45) Date of Patent: May 5, 2026

(54) COLLAPSIBLE WATER BUCKET WITH SCREW-ON LID

(71) Applicant: Colapz Ltd, London (GB)

(72) Inventor: Shaun Moore, Rotherham (GB)

(73) Assignee: Colapz Ltd, London (GB)

( * ) Notice: Subject to any disclaimer, the term of this patent is extended or adjusted under 35 U.S.C. 154(b) by 0 days.

(21) Appl. No.: 18/424,556

(22) Filed: Jan. 26, 2024

(65) Prior Publication Data

US 2025/0242979 A1 Jul. 31, 2025

(51) Int. Cl.
*B65D 43/02* (2006.01)
*B65D 21/08* (2006.01)
*B65D 37/00* (2006.01)

(52) U.S. Cl.
CPC ..... *B65D 43/0231* (2013.01); *B65D 21/086* (2013.01); *B65D 37/00* (2013.01); *B65D 2313/00* (2013.01); *B65D 2543/00092* (2013.01); *B65D 2543/00537* (2013.01)

(58) Field of Classification Search
CPC ... A45F 3/20; A45F 2003/205; B65D 21/086; B65D 37/00; B65D 43/0231; B65D 2313/00; B65D 2543/00092; B65D 2543/00537; B65D 1/40; B65D 1/0292; B65D 1/225; A47G 19/12; A47G 2019/2277; Y10S 215/90
USPC ..... 220/288, 6, 666
See application file for complete search history.

(56) References Cited

U.S. PATENT DOCUMENTS 1,581,418 A * 4/1926 Baker ..... A45F 3/20 229/400
8,313,000 B1 * 11/2012 Tuan ..... A45F 3/16 220/573.1
9,079,685 B2 * 7/2015 Sudakoff ..... B65D 43/0218
10,196,169 B2 * 2/2019 Tsui ..... D06F 95/002
11,618,611 B2 * 4/2023 Swarts ..... B65D 43/0212 220/6
2013/0032592 A1 * 2/2013 Lee ..... B65D 21/086 220/8
2015/0083736 A1 * 3/2015 Wheeler ..... B65D 21/086 220/666
2015/0251808 A1 * 9/2015 Tsui ..... D06F 95/002 211/41.6
2017/0253363 A1 * 9/2017 Feeley ..... A47G 19/02
2018/0194517 A1 * 7/2018 Brooks ..... B65D 81/3865
2019/0075973 A1 * 3/2019 Charleson ..... A47J 43/27
2019/0085503 A1 * 3/2019 Tsui ..... B29C 45/0017
2019/0119000 A1 * 4/2019 Tsui ..... B29D 22/003
(Continued)

OTHER PUBLICATIONS https://colapz.co.uk/collections/water-containers/products/colapz-201 (Year: 2025).*
https://www.youtube.com/watch?v=AyaD_3Vrcto&t=123s (Year: 2025).*

*Primary Examiner* — Gideon R Weinerth
(74) *Attorney, Agent, or Firm* — Tarter Krinsky & Drogin LLP

(57) ABSTRACT

A portable collapsible container for transporting fluids. The container is formed of flexible walls that can be folded to collapse the container. A specialized rim is connected to the container walls through a transition collar which enables a hard rim to be joined to relatively soft and pliable walls. A metallic ring is embedded in an upper aspect of the container to maintain the container in cylindrical form and prevent denting of the rim which could cause separation of the lid from the rim.

7 Claims, 5 Drawing Sheets

(56) References Cited

U.S. PATENT DOCUMENTS

| | | | | |
|---|---|---|---|---|
| 2020/0305619 | A1* | 10/2020 | Tsui | B65D 1/0292 |
| 2021/0047069 | A1* | 2/2021 | Zhu | A47K 1/04 |
| 2022/0009676 | A1* | 1/2022 | Tuan | B65D 39/12 |
| 2022/0227530 | A1* | 7/2022 | Cheetham | B65D 1/0292 |
| 2023/0054953 | A1* | 2/2023 | Graham | B65D 55/08 |
| 2023/0404247 | A1* | 12/2023 | Tuan | B65D 1/46 |
| 2025/0242979 | A1* | 7/2025 | Moore | B65D 43/0231 |

* cited by examiner

COLLAPSIBLE WATER BUCKET WITH SCREW-ON LID

FIELD OF THE INVENTION

The invention relates to the field of water containers, more specifically to a collapsible water container.

BACKGROUND OF THE INVENTION

Portable containers are widely used to transport water for different purposes such as drinking and bathing. For example, campers may wish to carry quantities of water for drinking and showering. Collapsible containers are known in the art, but such containers are not adapted to store high volumes of water. Moreover, the lids for known collapsible containers are secured via frictional engagement which are not as secure as a threaded engagement.

SUMMARY OF THE INVENTION

Embodiments of the invention provide a container formed of collapsible walls, but which includes a hard plastic threaded collar and mating lid. Embodiments of the invention, thus, provide a container that holds significantly more fluid than known containers and also includes a secure screw-top lid.

DETAILED DESCRIPTION OF THE INVENTION

Embodiments of the present invention will now be described with reference to the above-identified figures of the drawings. However, the drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein, all without departing from the spirit of the invention.

Figure 1:
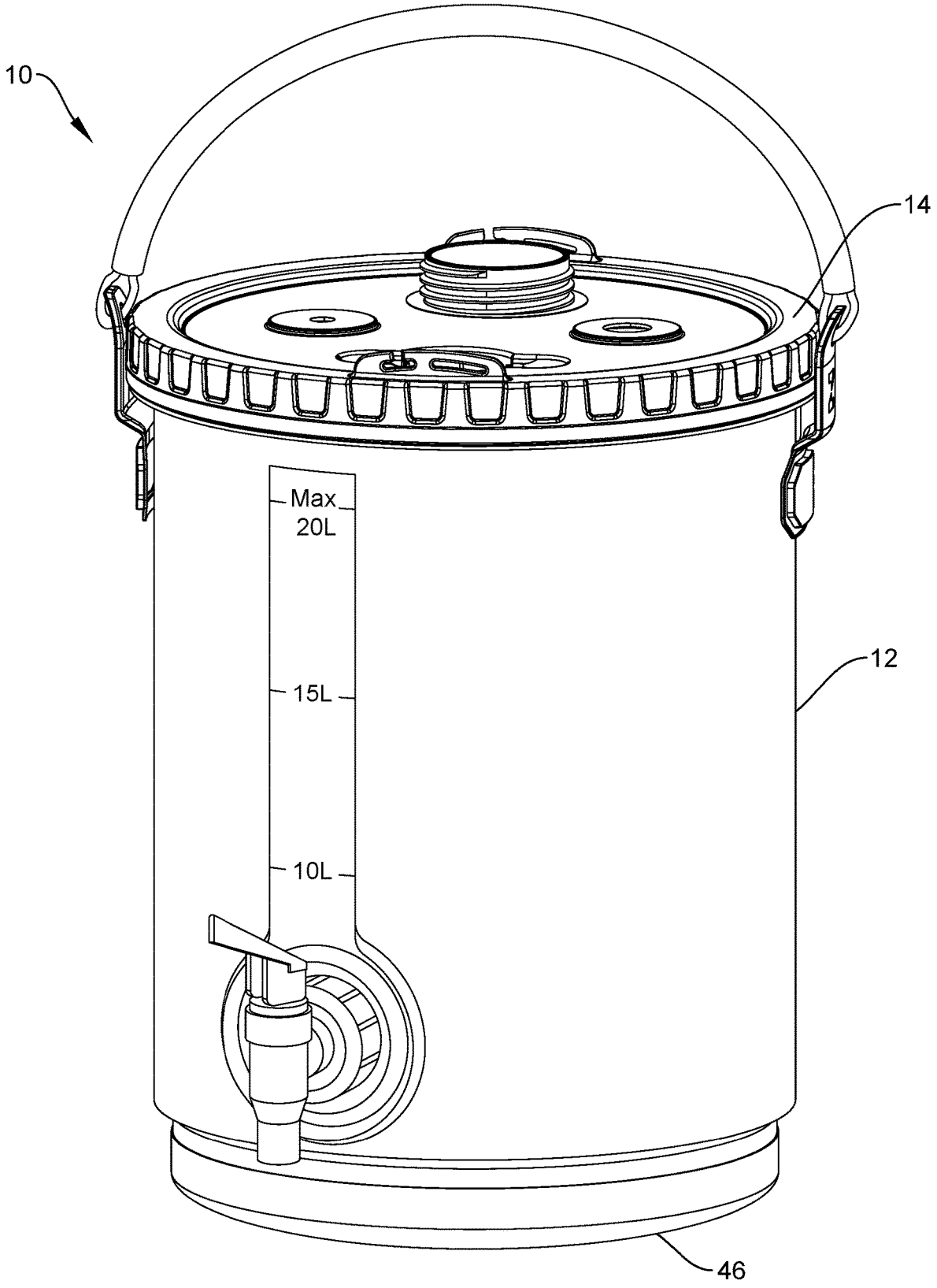
FIG. 1 is a front perspective view of a collapsible container in accordance with an embodiment of the invention.

With reference to FIG. 1, a container 10 is shown having container walls 12 and a cooperating lid 14. In embodiments of the invention, container walls 12 are formed of a material that can be folded yet retain its integrity. In this manner, container walls 12 may be folded and compressed for storage purposes and serve as stable container walls when filled with water.

In an embodiment of the invention, walls 12 are formed of Ethylene-vinyl acetate (EVA) sheets (also known as poly(ethylene-vinyl acetate)). EVA walls remain stable when holding water—but are also foldable and configured to enable compaction of the container when it is empty.

Figure 2:
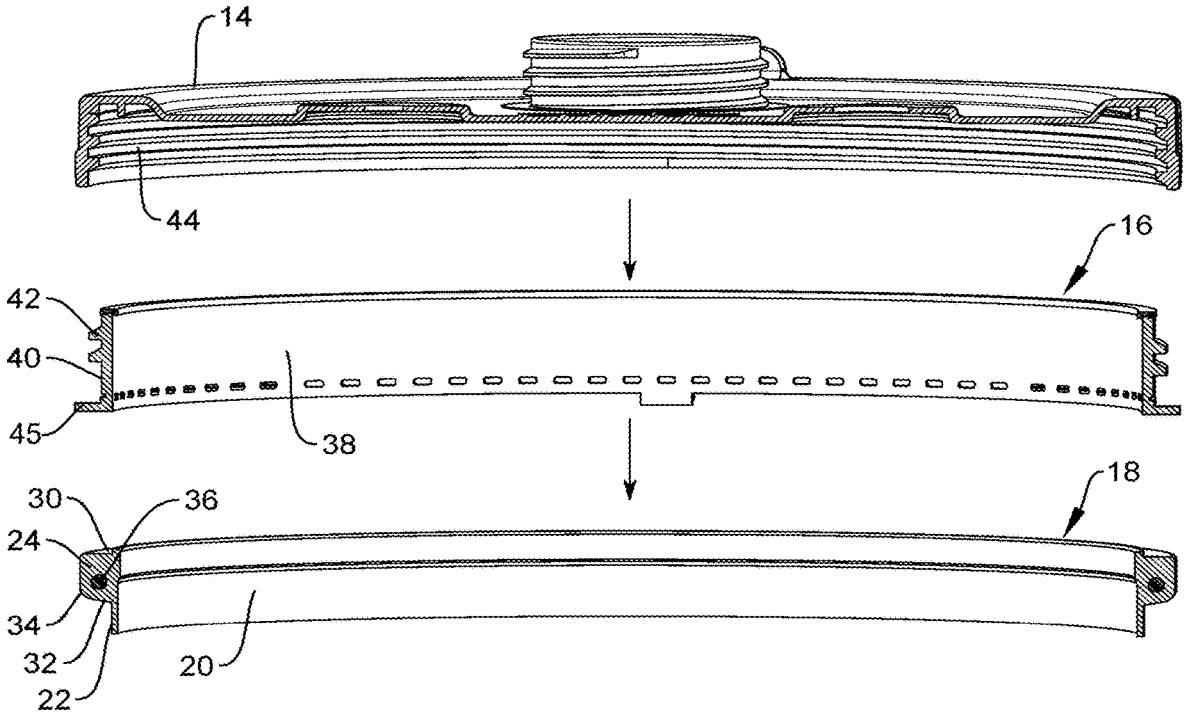
FIG. 2 is an exploded cross-sectional view of a container lip and lid in accordance with an embodiment of the invention.

With reference to the exploded cross-sectional view of FIG. 2, container 10 has an upper rim 16 that is configured to receive a threaded lid (e.g. 14). In embodiments of the invention upper rim 16 is joined to a lower collar segment 18. Upper rim 16 is formed of polypropylene or a similar rigid plastic material. In embodiments of the invention, polypropylene material of upper rim 16 is of sufficient hardness to tightly engage a hard plastic lid (e.g. lid 14) that is preferably also formed of polypropylene. In a preferred embodiment, lid 14 mates with upper rim 16 in a threaded engagement.

In embodiments of the invention, the hard plastic material (e.g. polypropylene) of which upper rim 16 is incapable of being welded directly to the EVA material of the soft, foldable container walls 12. In this regard, in embodiments of the invention, in order to attach upper rim 16 to the container walls 12, a lower collar segment 18 serves as a bridging member which mediates attachment of container walls 12 to upper rim 16. In embodiments of the invention, lower collar segment 18 is formed of EVA having a hardness value that is between the hardness value of EVA container walls 12 and the hardness value of upper rim segment 16.

In embodiments of the invention, upper rim 16 and collar segment 18 are formed via a two-shot injection molding process which combines EVA and polypropylene. As a result, a single unit is formed whereby collar segment 18 is formed of EVA material and upper rim 16 segment is formed of polypropylene material. In this regard, polypropylene upper rim 16 engages with polypropylene formed lid 14—allowing for a water-tight seal.

In embodiments of the invention upper segments of EVA container walls 12 are heat welded to EVA lower collar segment 18. In embodiments of the invention, the unit formed by lower collar segment 18 and upper rim 16 bridges the EVA materials of container 10 (walls 12 and collar segment 18) to the polypropylene materials of container 10 (upper rim 16 and lid 14).

With continued reference to FIG. 2, lower collar segment 18 is formed of a curved inner wall 20 and outer wall 22. As shown, an extension segment 24 extends laterally away from outer wall 22. In embodiments of the invention, outer wall 22 of collar segment forms a structural rib that is configured to adhere to inner surfaces of container walls 12. For example, with reference to FIG. 3, a section of container wall 12 is shown having an inner surface 26 and an outer surface 28. Inner surface 26 is adhered (preferably via heat weld) to outer wall 22 of collar segment 18 (below extension segment 24).

As shown, in FIG. 2, extension segment 24 has an upper surface 30, an underside surface 32 and a bridging wall 34 that forms a block of EVA material. In embodiments of the invention, a metal ring 36 is embedded within extension segment 24.

In embodiments of the invention, upper rim 16 is formed of a curved inner rim wall 38 and outer rim wall 40. As shown, threads 42 formed on outer rim wall 40 that are configured to mate with threads 44 provided on an inner wall of lid 14.

A lower aspect of upper rim segment 16 is configured to be adhered to lower collar segment 18. In an embodiment of the invention, a flange or similar rim extension 45 is provided to contact and connect to lower collar segment 18.

Figure 3:
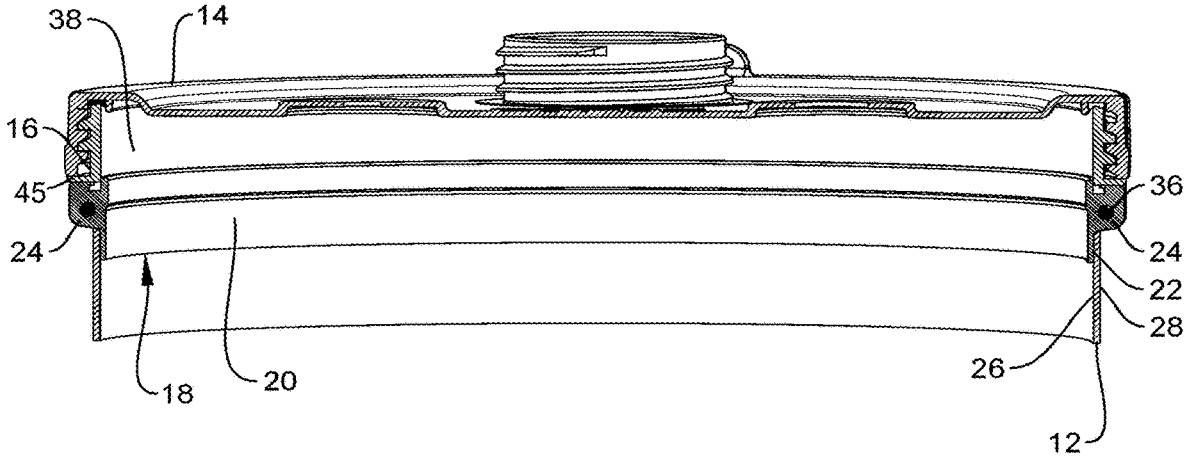
FIG. 3 is a broken away cross-sectional view of a container lip and lid in accordance with an embodiment of the invention.

For example, as best shown in FIG. 3, an underside surface of rim extension 45 is seated on and joined to upper surface 30 of extension segment 24.

With reference to FIG. 3, metal ring 36 completely encircles the container walls 12 and is located just below the upper rim 16. In this regard, ring 36 provides structural support to maintain the rounded aspect of container walls 12. In this regard, in the event that the filled container 10 is bumped from the side, ring 36 ensures that the rim segment 16 will not dent or deform which would risk separation of the lid 14 from upper rim segment 16.

Figure 4:
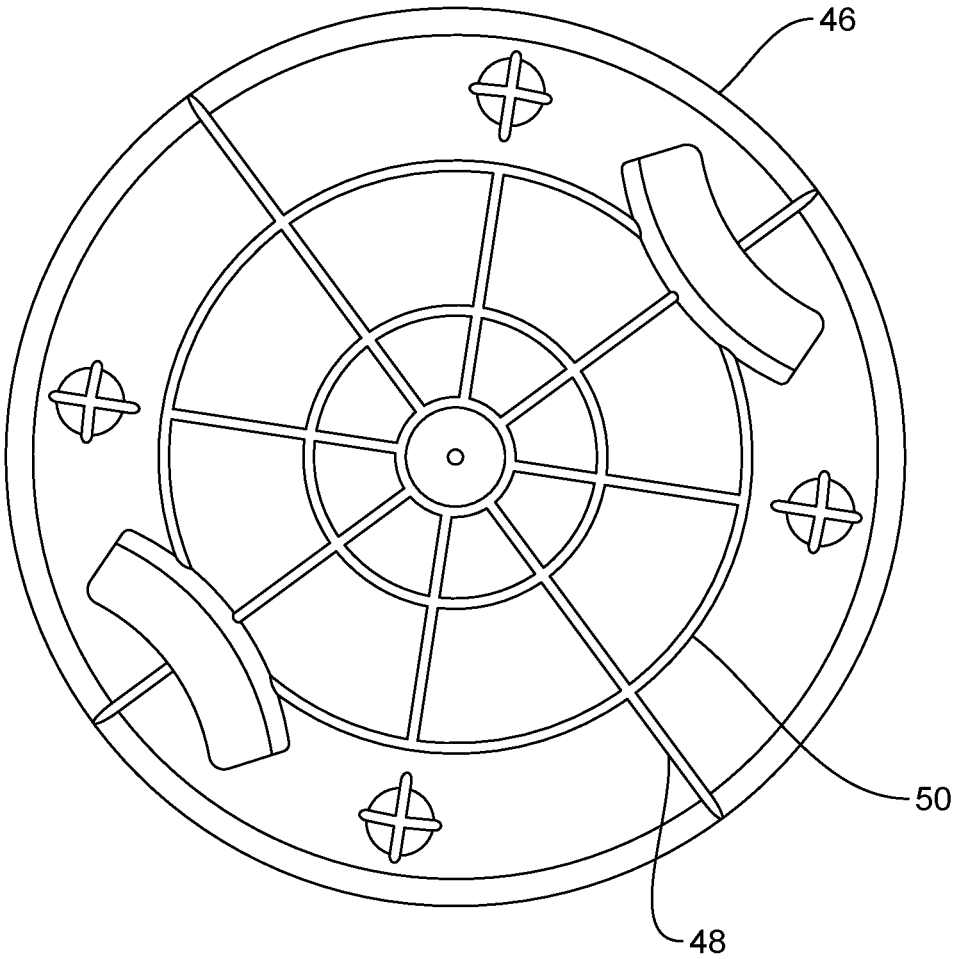
FIG. 4 is a top view of a container base plate in accordance with an embodiment of the invention.

FIG. 4 shows a base plate 46 that is configured to provide added strength and stability. For example, as shown, base plate 46 is provided with ribs or similar support structures. In embodiments, ribs (e.g. 48) extend from a peripheral aspect of base plate 46 and converge toward the center base plate 46. Other ribs (e.g. 50) may be formed of substantial circles or concentric circles. In embodiments of the invention, both ribs 48, 50 intersect at one or more points to confer additional strength and durability.

Figure 5:
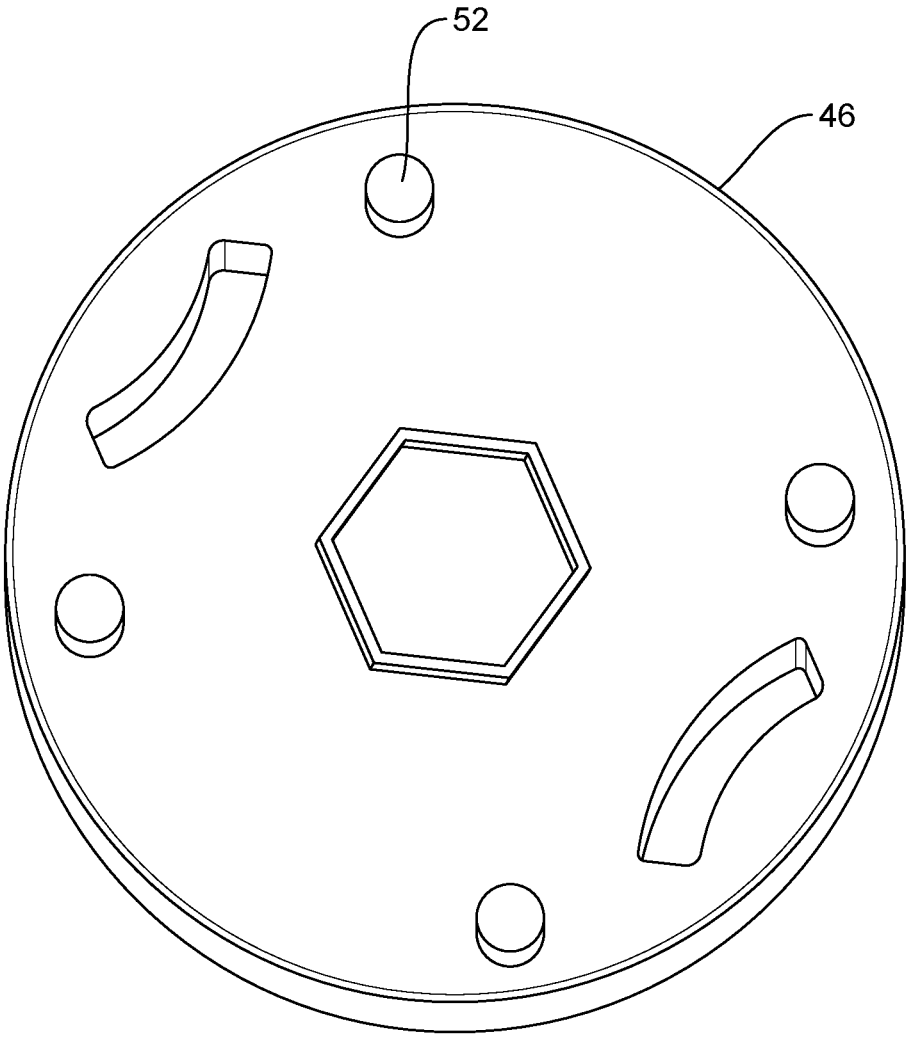
FIG. 5 is a view of an underside surface of a container base plate in accordance with an embodiment of the invention.

FIG. 5 shows an underside surface of base plate 46. As shown, in embodiments of the invention a series of legs 52 extend from the underside surface to add stability to the unit when placed on a flat surface.

Embodiments of the invention provide a method for producing a container or vessel capable of holding a large volume of water. The method includes the steps of providing a substantially cylindrical shaped wall formed of a pliable, yet durable material, such as for example, EVA. The method further includes the step of performing a two-shot injection molding process to form a unit consisting of i) an EVA lower collar segment having a rib segment that is configured to contact the inside surface of the cylindrical wall, and ii) a polypropylene upper rim segment. The method includes welding the top segment of the cylinder-shaped wall to the collar segment. In embodiment of the invention, the method of joining the cylindrically-shaped wall include using a collar segment that is formed of EVA material having a greater hardness than that of cylindrical-shaped wall.

Embodiments of the invention further include the step of embedding a metallic, or such similarly rigid ring, into the collar segment. For example, collar may be injection molded around a metal ring, which becomes embedded within the collar. Alternatively, collar may be formed with a slit and inner lumen such that a ring may be urged into the inner lumen via the slit.

A user may collapse the container by folding the walls into a compact unit, for example, for purposes of storage. When the user desires to use the container for storing water, the user need only unfold the walls and add water into the inner cavity formed by the walls. Water held within the container will exert pressure outwardly on the container walls and thereby help to maintain the walls in a cylindrical formation.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A container, comprising:

a base plate;

a flexible wall having an outer surface and an inner surface, the flexible wall extending upwardly from the base plate;

a collar segment, comprising:

a curved wall having an inner surface and an outer surface, the curved wall comprising an extension section extending outward from the outer surface of the curved wall, wherein the outer surface of the curved wall is configured to adhere to the inner surface of the flexible wall;

a rigid ring embedded within the extension section of the collar segment;

an upper rim comprising:

a rounded wall having a top end and a bottom end and an inner surface and outer surface;

the bottom end joined to the collar segment;

whereby the flexible wall comprises material of a first hardness, and the collar segment comprises material of a second hardness.

2. The container of claim 1, whereby the upper rim comprises material of a third hardness and whereby the second hardness is greater than the first hardness and the third hardness is greater than the second hardness.

3. The container of claim 1, whereby the rigid ring is formed of a metallic material.

4. The container of claim 1, whereby the outer surface of the upper rim comprises threads.

5. The container of claim 1, further comprising a lid.

6. The container of claim 5, whereby the lid comprises threads that cooperate with threads on the outer surface of the upper rim.

7. The container of claim 1, whereby the base plate comprises a series of support structures.

* * * * *